United States Patent [19]

Field

[11] Patent Number: 4,709,615

[45] Date of Patent: Dec. 1, 1987

[54] ELECTRICAL FIRING SYSTEMS

[75] Inventor: John R. Field, Fareham, England

[73] Assignee: Plessey Overseas Limited, Ilford, England

[21] Appl. No.: 731,899

[22] Filed: May 8, 1985

[30] Foreign Application Priority Data

May 10, 1984 [GB] United Kingdom ..... 8411977

[51] Int. Cl.[4] ..... F23Q 5/00; H01H 47/00

[52] U.S. Cl. ..... 89/1.56; 89/1.814; 89/28.05; 102/217; 361/139; 307/132 R

[58] Field of Search ..... 102/217, 206, 352, 360, 102/338, 438, 504, 505, 345; 361/249, 250, 139, 191; 89/1.3, 1.51, 1.56, 1.814, 28.05; 42/84; 307/113, 132 R

[56] References Cited

U.S. PATENT DOCUMENTS

| | | | |
|---|---|---|---|
| 1,454,990 | 5/1923 | Wilcke | 361/191 |
| 3,892,182 | 7/1975 | Covarrubias et al. | 102/217 |
| 4,135,455 | 1/1979 | Wallace | 102/505 |
| 4,222,306 | 9/1980 | Maury | 89/1.41 |
| 4,586,439 | 5/1986 | Wrana | 102/505 |

*Primary Examiner*—Deborah L. Kyle
*Assistant Examiner*—Michael J. Carone
*Attorney, Agent, or Firm*—Fleit, Jacobson, Cohn & Price

[57] ABSTRACT

An electrical firing arrangement for the sequential firing of a plurality of mortars stacked in end-to-end relationship within a single launching barrel. The firing arrangement comprises a pulse generator for producing mortar firing pulses and a circuit for applying these pulses to an electro-magnetic stepping switch which applies the pulses in turn over pairs of wires to igniters of the respective mortars as the stepping switch is stepped from one position to the next. The stepping switch comprises normally-open contacts which close when an operating coil is effectively energized by a firing pulse and switch wipers move out of engagement with one pair of associated contacts on the stepping switch towards the next pair of associated contacts on the same switch. The normally-open contacts are restored to their open condition when the operating coil is fully de-energized at the end of each firing pulse so that any short-circuit condition which may exist across a pair of associated contacts due to short-circuiting of a pair of wires to an igniter of a mortar being fired will not deprive the operating coil of current upon the arrival of a firing pulse whereby the stepping switch would fail to step to its next position.

3 Claims, 2 Drawing Figures

ELECTRICAL FIRING SYSTEMS

BACKGROUND

This invention relates to electrical mortar firing systems eminently suitable for use in heat-seeking missile-decoy systems.

Such missile decoy systems commonly comprise infra-red mortars which may be fired in succession from suitable launching means carried by the potential missile target and arranged to generate infra-red radiation at progressively increasing distances from the target.

The infra-red mortars may be stacked end-to-end in multiple mortar (e.g. seven) packs arranged to be electrically coupled within the barrel of mortar launching means to electrical mortar firing means.

The electrical mortar firing means may comprise an inductive coupling arrangement through which mortar firing pulses (i.e. bursts of a.c. of predetermined duration) are transmitted. The pulses are utilised, after rectification thereof by means of a full-wave rectifier, to step an electro-magnetic stepping switch which applies the pulses in turn to the igniters of the respective mortars of the pack as the switch is stepped from one position to the next. These pulses are applied to the igniters of the respective mortars over pairs of wires which extend from the firing means which is located at the base of the launcher barrel to the individual mortars of the multiple pack. On arrival of the first mortar firing pulse over the inductive coupling arrangement the stepping switch is operated to apply a proportion of the incoming pulse over an appropriate pair of wires to the igniter of the mortar located at the top end of the multiple pack. The top-most mortar is accordingly fired from the launching barrel and a pyrotechnic time fuse is simultaneously ignited which causes the mortar to generate infra-red radiation after a predetermined delay from launch.

The next mortar firing pulse to arrive will normally cause the stepping switch to step to its next outlet position at which it applies a proportion of the incoming pulse over the appropriate pair of wires to the igniter of the next mortar which was positioned immediately below the mortar just fired. The second mortar is accordingly fired and the pyrotechnic fuse of this mortar will usually be designed to permit the mortar to travel further from the launch point than the first mortar before it generates infra-red radiation. Subsequent firing pulses similarly cause the stepping switch to apply pulses in turn to the igniters of the remaining mortars yet to be fired, the pyrotechnic fuses of which will usually be designed to enable the mortars to travel pyrogressively greater distances than the mortars previously fired so that an approaching heat-seeking missile will be diverted away from the potential missile target.

One of the problems with such mortar firing systems is that short-circuiting of any of the aforesaid pairs of wires over which firing pulses are applied to the igniters of the mortars or shorting of the igniter itself can prevent operation of the stepping switch to its next outlet for firing the next mortar in the multiple pack. Consequently, the entire mortar pack or a part thereof may be rendered useless by such short-circuiting which will most likely occur as a result of fusing together of the ends of the aforesaid pairs of wires by the heat generated by the appertaining mortar igniter as the mortar is fired. The fusing together of these wire ends then prevents the re-operation of the stepping switch to apply the next incoming firing pulse to the next mortar to be fired.

SUMMARY

According to the present invention there is provided an electrical firing arrangement of the general form described eminently suitable for firing mortars (e.g. infra-red), in which the electro-magnetic stepping switch is provided with normally-open contact means which are arranged to close following effective energisation of the operating coil of the switch by an incoming firing pulse but after movement of switch wipers out of engagement with one pair of associated contacts and towards the rext pair, the contact means being restored to their normally-open condition and the energising coil of the switch being fully de-energised at the end of each firing pulse, said normally-open condition of the contact means serving to prevent a short-circuit condition which may exist across a pair of contacts engaged by the wipers of the stepping switch from depriving the energising coil of current upon the arrival of a firing pulse whereby the stepping switch would fail to step to its next position.

BRIEF DESCRIPTION OF THE DRAWINGS

By way of example the present invention will now be described with reference to the accompanying drawings in which.

DETAILED DESCRIPTION

Figure 1:
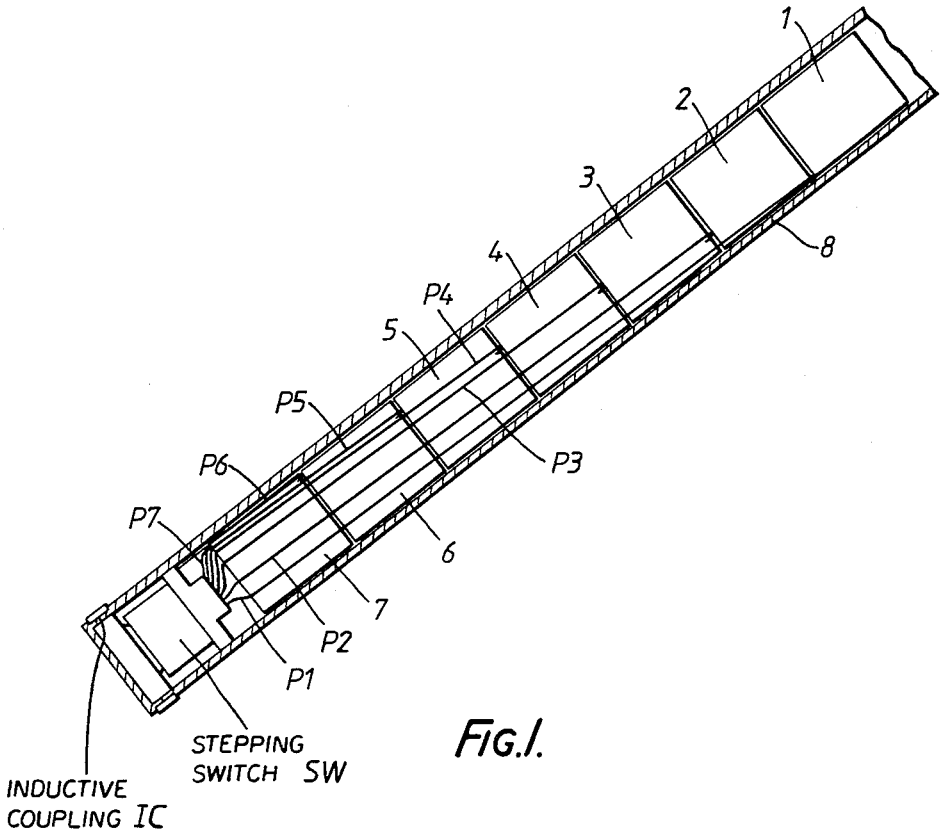
FIG. 1 is a diagrammatic view of a multiple pack of infra-red decoy mortars located within the barrel of launching means; and, FIG. 2 is a circuit diagram of the electrical firing arrangement for the mortars of FIG. 1.

Referring to FIG. 1 of the drawings a multiple mortar pack comprising seven mortars 1 to 7 end-to-end relationship is located within the barrel 8 of mortar launching means. The mortars 1 to 7 are arranged to be fired sequentially by applying firing pulses in turn to pairs of wires P1, P2, P3 to P7 which run along the side of the mortar pack and which are terminated by respective igniters (not shown) located within the mortars 1 to 7. When a mortar is fired a pyrotechnic timing fuse (not shown) is simultaneously ignited and after a predetermined time interval the timing fuse produces ignition of infra-red generating means within the mortar for producing an infra-red aerial display as a decoy for heat-seeking missiles.

This predetermined time interval between the firing of a mortar and the generation of the infra-red decoy display will increase progressively for each mortar fired so that the overall infra-red display will draw the missile away from a missile target (e.g. ship) from which the mortars are fired.

Figure 2:
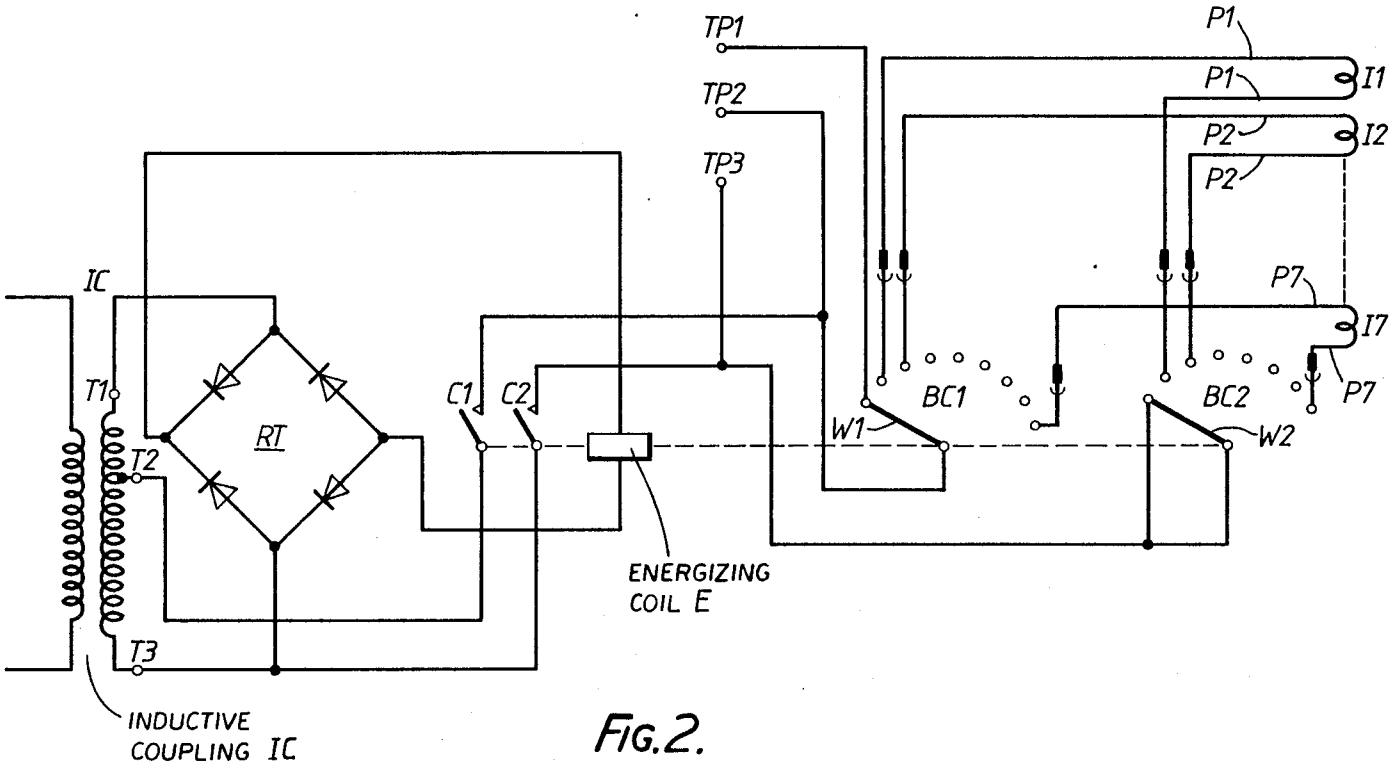

Referring now also to FIG. 2 it will be seen that the wires of each pair of wires P1 to P7 which are respectively bridged by the mortar igniters I1 to I7 are connected respectively to corresponding contacts of banks of contacts BC1 and BC2 of an electromagnetic stepping switch SW (FIG. 1) having an energising coil E and wipers W1 and W2 for selective engagement, respectively, with the arc contacts of the banks BC1 and BC2.

The firing pulses which are applied sequentially over the pairs of wires P1 to P7 are derived from pulse generating means (not shown). These pulses comprise bursts of AC (e.g. 8 to 10 KHz) typically having a duration of about 50 milliseconds.

In operation of the firing system the firing pulses are transmitted through an inductive coupling IC so that they are received between terminals T2 and T3 and applied to a full-wave bridge rectifier RT the dc output of which is applied to the energising coil E of the stepping switch. The coil E is accordingly energised and causes the wipers W1 and W2 to move from their rest position as indicated and away from the rest position contacts of banks BC1 and BC2 towards the first contacts of the banks BC1 and BC2. Before or immediately after the wipers W1 and W2 reach these contacts the normally-open contacts C1 and C2 of the stepper switch SW close so that part of the pulse received over the inductive coupling and developed between terminals T2 and T3 will be applied via the wipers W1 and W2 to the first pair of wires P1 as the wipers make contact with the next arc contacts. The wires P1 are bridged by the igniter I1 of the top-most mortar of the mortar pack. The pulse accordingly produces fusing of the igniter I1 which causes the mortar to be fired. At the end of the first incoming firing pulse the coil E of the stepper switch SW de-energised and the contacts C1 and C2 will open. When the next firing pulse is received the procedure is repeated whereby the coil E is again fully energised and the wipers W1 and W2 move away from the second contacts towards the third contacts of the banks BC1 and BC2. The contacts C1 and C2 again close before or immediately after the wipers W1 and W2 engage the third contacts of the banks BC1 and BC2 so that when engagement does take place that part of the pulse developed between the terminals T2 and T3 will be applied via the wipers W1 and W2 to the pair of wires P2 and the igniter I2.

As will be appreciated from a consideration of the circuit diagram, a short-circuit which occurs across any of the pairs of wires P1 to P7, as may occur when a mortar is being fired, cannot prevent the re-operation of the energising coil E to enable the stepping switch to be stepped on to its next outlet to facilitate the firing of the next mortar. This is due to the fact that the switch contacts C1 and C2 do not close until after the wipers have moved away from one set of contacts of the banks BC1 and BC2 to the next set. Moreover, in the case of one mortar failing to be fired from the pack the present invention enables the next mortar to be fired so as to impel the failed mortar out of the launching barrel.

The contacts TP2 and TP3 enable the resistance of the mortar igniters I1 to I7 to be tested when the contacts C1 and C2 are open. Continuity testing of the winding between T2 and T3 can be carried out by holding contacts C1 and C2 closed.

A short-circuit test for the wiper W1 can be carried out between contacts TP1 and TP2.

I claim:

1. An electrical firing arrangement for firing in sequence a plurality of mortars stacked in end-to-end relationship within the barrel of a mortar launching means comprising:

an electromagnetic stepping switch including an operating coil, a normally-open make and break switch contact means, and a wiper switch contact means having movable wipers and a plurality of associated fixed contacts;

means for applying energising pulses to the electromagnetic stepping switch to produce a stepping operation of the electromagnetic stepping switch in response to successive energisations of the operating coil;

means for applying, simultaneously with said energising pulses, mortar firing pulses in sequence to igniters of the respective mortars through said normally-open make and break switch contact means when said normally-open switch make and break contact means are in the closed condition and through a respective conductor means as the electromagnetic switch and movable wipers are stepped from one position thereof to the next; and said energising pulses and said mortar firing pulses being derived from said means for applying energising pulses and closure of said normally-open make and break switch contact means responsive to the energisation of the operating coil by each of said energising pulses being delayed until after movement of said moveable wipers of the wiper switch contact means out of engagement with one pair of associated fixed contacts and towards the next pair of contacts to prevent a short-circuit condition which may exist across any pair of associated fixed contacts of the wiper switch contact means due to short-circuiting of the respective conductor means from depriving the opreating coil of an energising pulse whereby the electromagnetic stepping switch would fail to step to its next position.

2. The electrical firing arrangement of claim 1, wherein said means for applying energising pulses to the electromagnetic stepping switch comprises an inductive coupling arrangement and a full wave rectifier circuit.

3. The electrical firing arrangement of claim 2, wherein said motor firing pulses apllied sequentially to the igniters of the mortars are a.c. pulses derived from the inductive coupling arrangement.

* * * * *